US006273842B1

(12) United States Patent
Wang et al.

(10) Patent No.: US 6,273,842 B1
(45) Date of Patent: Aug. 14, 2001

(54) ELECTRIC TREADMILL WITH A SINGLE MOTOR FOR ADJUSTING THE HEIGHT OF A RUNNING BOARD AND FOR FOLDING THE TREADMILL

(76) Inventors: Leao Wang; Peter Wu, both of No 1, Lane 233, Sec. 2, Charng Long Rd., Taiping 411 (TW)

( * ) Notice: Subject to any disclaimer, the term of this patent is extended or adjusted under 35 U.S.C. 154(b) by 0 days.

(21) Appl. No.: 09/586,919

(22) Filed: Jun. 5, 2000

(51) Int. Cl.[7] ..... A63B 22/02
(52) U.S. Cl. ..... 482/54
(58) Field of Search ..... 482/51, 54

(56) References Cited

U.S. PATENT DOCUMENTS 5,860,893 * 5/1999 Watterson et al. ..... 482/54
5,899,834 * 5/1999 Watterson et al. ..... 482/54
5,921,893 * 7/1999 Hurt ..... 482/54

* cited by examiner

*Primary Examiner*—Glenn E. Richman
(74) *Attorney, Agent, or Firm*—Kuo-Hsiung Chiu

(57) ABSTRACT

The present invention relates to an improved electric treadmill with a single motor for adjusting the height of a running board and for folding the treadmill in which another motor is provided at the bottom of the running support in order to transmit a worm shaft which drives a gearbox in order for a polygonal output shaft at two sides of said gearbox to rotate at the original position; thereafter, two connecting rods of pulley blocks are driven to perform a height-adjusting action of the treadmill. Moreover, the actuating rod includes a pin at a proper position, and the running support contains a hole so that a pivoting fixing is created by means of the pin and the hole. Accordingly, after the two actuating rods are driven by the motor and another parts, the running support can be lifted or lowered in order to achieve the folding effect of the treadmill.

3 Claims, 4 Drawing Sheets

ELECTRIC TREADMILL WITH A SINGLE MOTOR FOR ADJUSTING THE HEIGHT OF A RUNNING BOARD AND FOR FOLDING THE TREADMILL

BACKGROUND OF THE INVENTION

1. Field of the Invention

The present invention relates to an improved electric treadmill, and more particularly to a treadmill with a single motor for adjusting the height of a running board and for folding the treadmill.

2. Description of the Prior Art

The treadmill is an excellent exercise apparatus for the user to make a jogging exercise on the same ground. Simply to speak, it is operated by a main motor to drive a belt which then drives a front and a rear roller unit so that the running belt disposed around the roller unit rotates unceasingly. Therefore, the user can stand on the running belt and make a jogging exercise in accordance with the rotation speed of the running belt.

However, this product is very big and heavy so that it's generally equipped with a lifting and folding apparatus for lifting the running support in order to reduce the occupied space and to facilitate its storage or transportation. In addition, this product is unsuitable for the old and the weak because of its heaviness of the body. Moreover, an apparatus for adjusting the angle of the elevation of the running support is provided to simulate the ground of different slopes.

These two (height-adjusting and folding). units of the prior art treadmill are both manually or electrically operated, or one is manually and the other is electrically operated. No matter how they are operated, they are unpractical in using so that the purchasing and using desire of the user is tremendously reduced. However, the electrically operated type is too expensive that the consumer who desires to purchase it can't afford it.

The reason why the electrically operated type is too expensive lies in that the height-adjusting and folding units have to be fitted with a motor respectively for driving them. In addition, the cost of the material and the assembly for related transmission parts of the motor will also be increased.

SUMMARY OF THE INVENTION

It is a primary object of the present invention to provide an improved electric treadmill with a single motor for adjusting the height of a running board and for folding the treadmill which can remove the above-mentioned disadvantages of the conventional treadmill without losing the original functions in order to increase the using convenience and to reduce the production cost.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
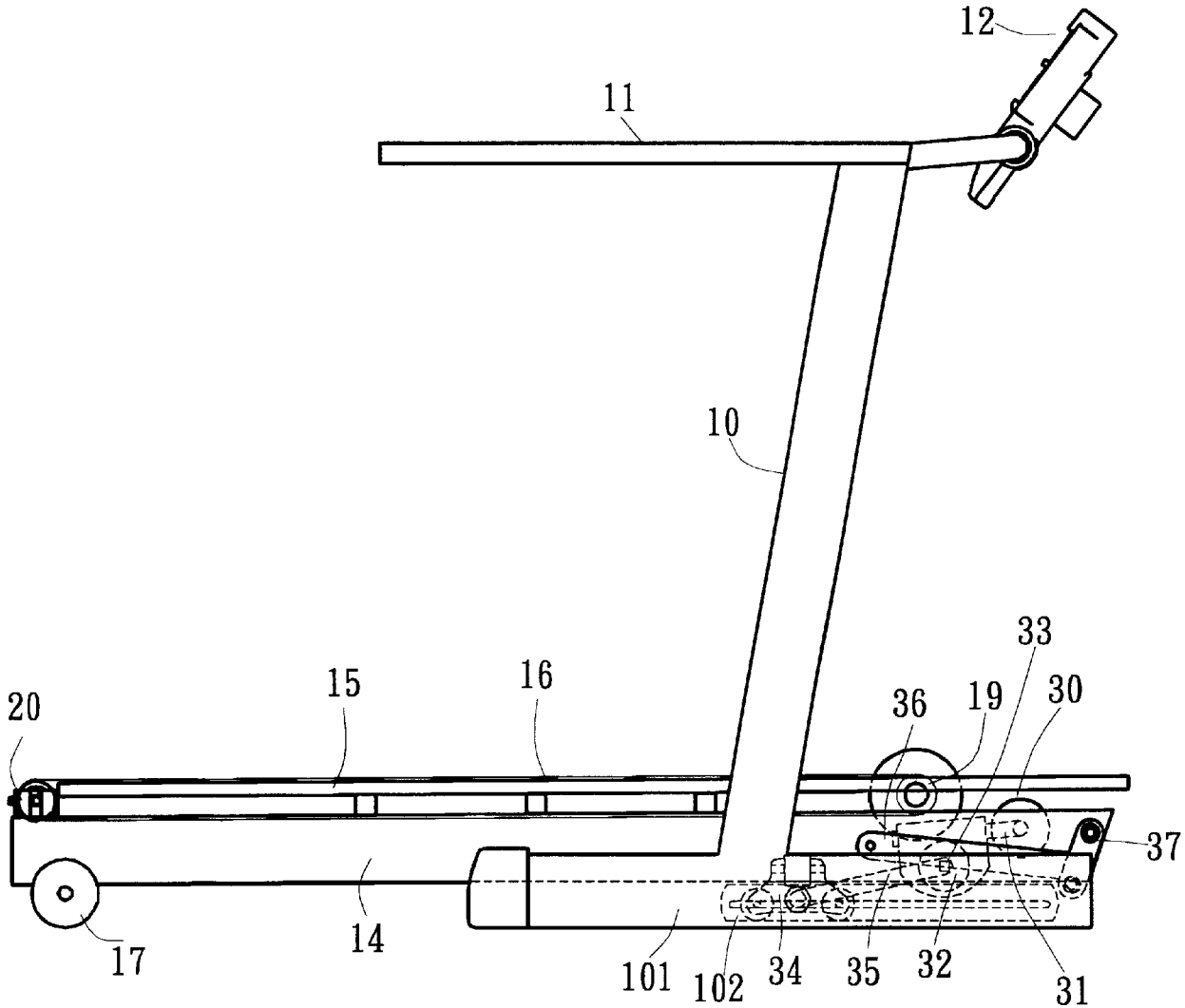
FIG. 1 is a side view of an assembled treadmill of the present invention, illustrating each part thereof.
Figure 2:
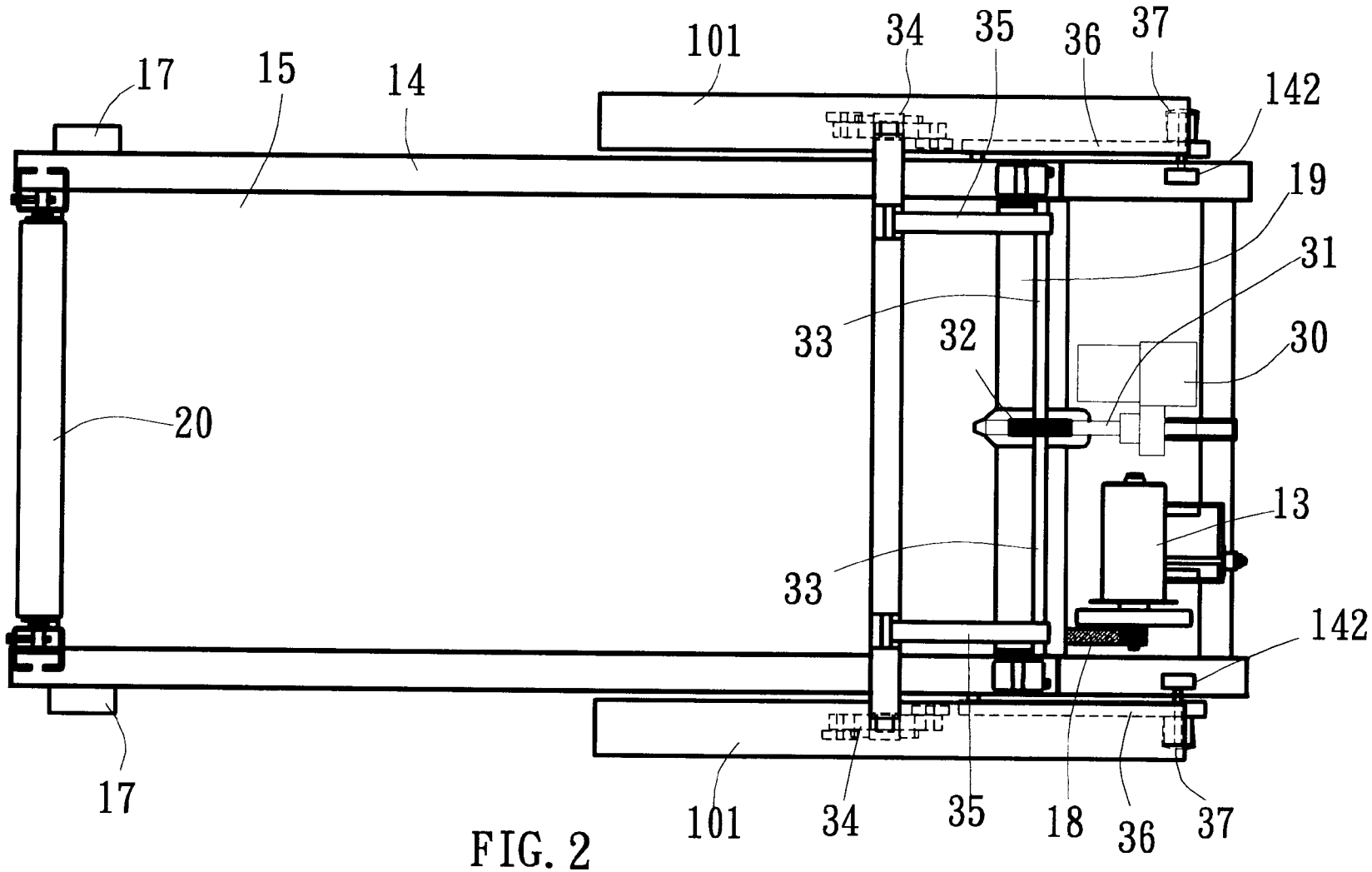
FIG. 2 is a bottom view of the local parts of the present invention.

First of all, referring to FIGS. 1 and 2, the exercise treadmill in accordance with the present invention primarily includes a treadmill frame 10, a hand rest 11, an electric control panel 12, a main motor 13, a running support 14, a running board 15, a running belt 16 and a supporting rear wheel 17. The main motor 13 transmits a belt 18 which drives a front roller 19. Moreover, the running belt 16 circles around the front and rear rollers 19, 20 unceasingly by means of the rotation of the main motor 13.

Figure 4:
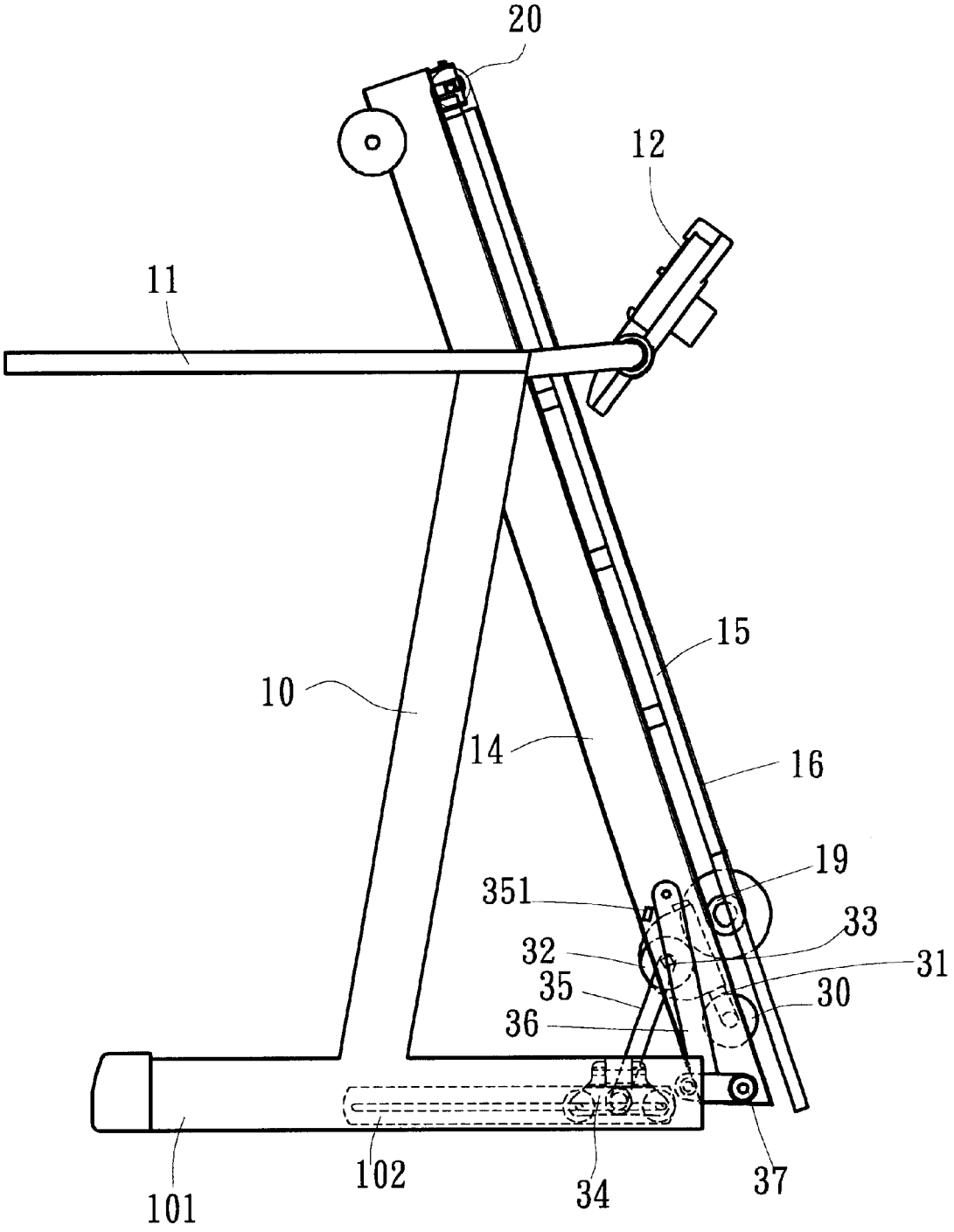
FIG. 4 is a schematic drawing of the action in folding the treadmill of the present invention by lifting the running support.

The present invention is characterized in that another motor 30 is provided at the bottom of the running support 14 in order to transmit a worm shaft 31 which drives a gearbox 32 in order for a polygonal output shaft 33 at two sides of the gearbox 32 to rotate driving two connecting rods 35 with wheels 34 to perform a height-adjusting action of the treadmill, pivotal fixing is achieved by holes 141 on the running support 14 for inserting the insertion pins 37 on two actuating rods 36. Thus the running support 14, as shown in FIG. 4, can be lifted or lowered in order to achieve the folding effect of the treadmill.

The wheels 34 are disposed in sliding rails 102 at the inner side of the horizontal section 101 of the treadmill frame 10 so that the sliding movement is limited by the sliding rails 102.

In order to avoid a false movement of the motor 30 and its related parts, the power supply system (not shown) of the main motor 13 will be then switched off after the pin 37 is plugged into the hole 141 of the running support 14 while the power supply for the lifting motor 30 won't be influenced. In brief, an electronic trigger switch 142 is disposed in the hole 141 and is connected with the power supply system of the main motor 13. Therefore, the power of the main motor 13 will be immediately switched off once the electronic trigger switch 142 is contacted. Accordingly, the pin 37 has to be unplugged from the hole 141 when the user wants to lower the running support 14 for use. Thus the using safety can be reached.

When the user uses the present invention for a jogging exercise, the pin 37 has to be pulled out of the hole 141 and the electronic trigger switch 142 therein so that the main motor 13 and the running belt 16 can make a smooth rotation. Meanwhile, the motor 30 can therefore be driven in order for the running support 14 to perform a height-adjusting movement and to change the angle of the elevation thereof.

The actuating rod 36 is moved when the running support 14 performs height-adjusting and folding actions. In order to avoid the running support 14 being raised too high to endanger the using safety when the user adjusts the angle of the elevation of the running support 14 while jogging on the treadmill, the actuating rod 36 is equipped with a position-limited switch 351 in connection with a power supply circuit (not shown) of the motor 30 for limiting the maximal angle of the elevation of the running support 14.

Figure 3:
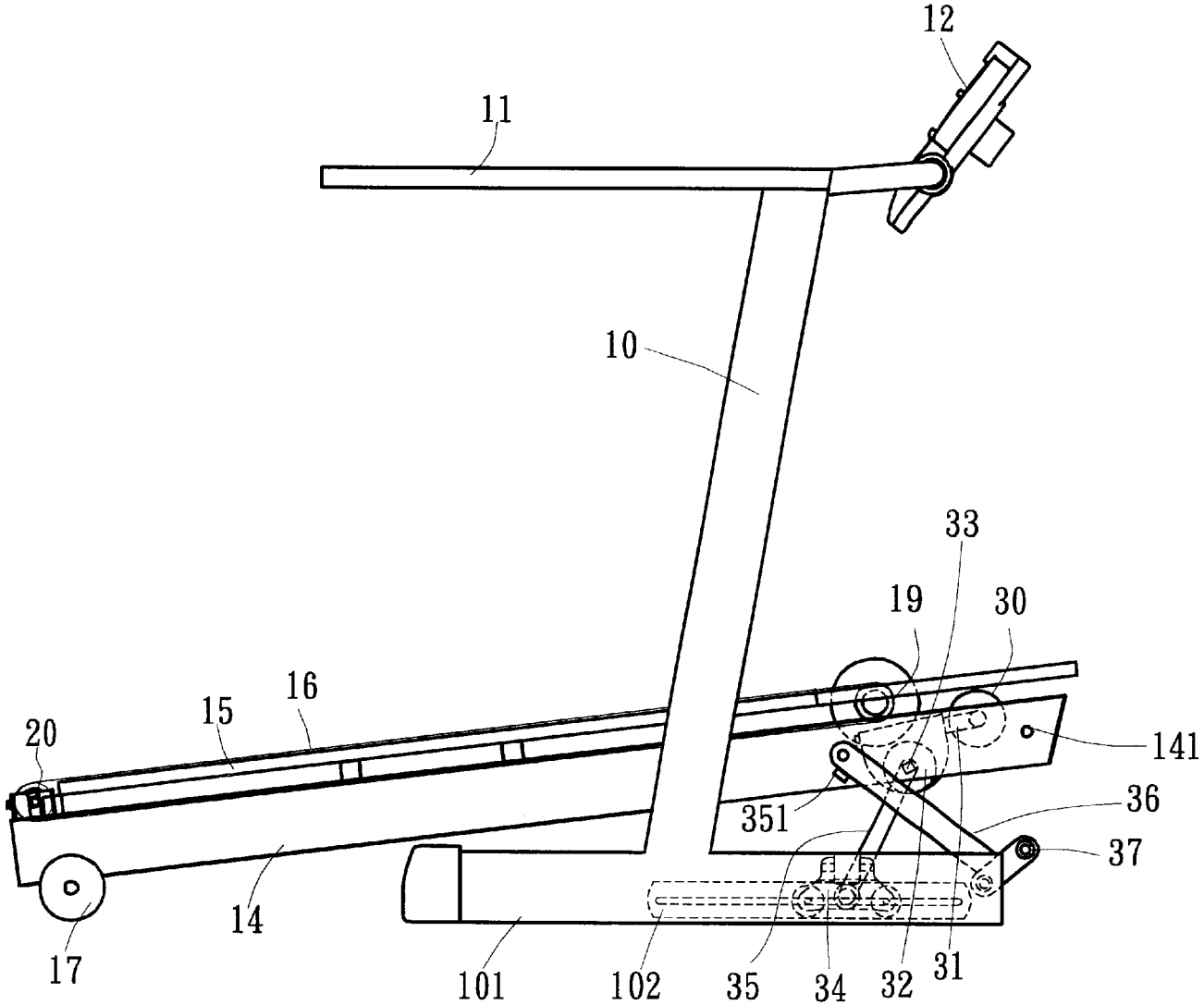
FIG. 3 is a schematic drawing of the action in adjusting the height of a running board of the present invention.

When the running support 14 performs a lifting-folding action, the angular relation between the actuating rod 36 and the running support 14 is fixed and constant, as shown in FIGS. 1 and 4. When the running support 14 performs a height-adjusting action, the angular relation between the actuating rod 36 and the running support 14 is changed, as shown in FIGS. 1 and 3. Accordingly, the maximal angle of the elevation of the running support 14 can be easily adjusted by means of the angular change of the actuating rod 36.

When the running support 14 performs the height-adjusting action, the position of the running support 14 must be shifted forwards and backwards. By means of the supporting rear wheel 17, the running support 14 can be smoothly moved.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An exercise treadmill having a treadmill frame with a horizontal section, a hand rail mounted on the frame and comprising:

a) a running support with a running belt thereon, the running support having a first end and a second end, with at least one rear wheel on the second end;

b) an L-shaped actuating rod pivotally connected to opposite sides of the running support adjacent the first end, and pivotally connected to the horizontal section of the treadmill frame;

c) a first motor to drive the running belt; and, d) a height adjusting and folding mechanism including:

i) a second motor driving a gearbox;

ii) output shafts extending from and rotated by the gearbox;

iii) connecting rods attached to the output shafts, each connecting rod having at least one wheel thereon; and, iv) sliding rails on the horizontal section of the treadmill frame, each sliding rail engaged by the at least one wheel so as to limit movement of the at least one wheel to a linear path having a predetermined length, whereby the height adjusting and folding mechanism adjusts a height of the first end of the running support and pivots the running support about the actuating rods between a use position and a folded position.

2. The exercise treadmill of claim 1 further comprising:

a) an insertion pin on each actuating rod; and, b) holes formed in the running frame and located so as to receive the insertion pins when the running support is in the folded position.

3. The exercise treadmill of claim 2 further comprising trigger switches disposed in the holes in the running frame and located so as to be actuated by the associated insertion pins whereby when the switches are actuated by the insertion pins, power to the first motor is cut off to prevent motion of the running belt when the running support is in the folded position.

* * * * *